US005133186A

United States Patent [19]

Weissinger

[11] Patent Number: 5,133,186

[45] Date of Patent: Jul. 28, 1992

[54] DEVICE FOR CONTROLLING THE PRESSURE IN A HYDRAULIC PRESSURE SYSTEM

[75] Inventor: Jürgen Weissinger, Dettingen, Fed. Rep. of Germany

[73] Assignee: Mercedes-Benz AG, Fed. Rep. of Germany

[21] Appl. No.: 601,394

[22] Filed: Oct. 23, 1990

[30] Foreign Application Priority Data

Oct. 24, 1989 [DE] Fed. Rep. of Germany ..... 3935325

[51] Int. Cl.[5] ..... F15B 7/10; G05D 16/04

[52] U.S. Cl. ..... 60/464; 60/468; 60/459; 417/295

[58] Field of Search ..... 60/459, 464, 468, 494; 417/295, 309

[56] References Cited

U.S. PATENT DOCUMENTS

| | | | |
|---|---|---|---|
| 3,182,596 | 5/1965 | Prijatel | 417/309 |
| 3,210,939 | 10/1965 | Nuss | 60/468 |
| 4,237,926 | 12/1980 | Walker | 60/459 X |
| 4,413,472 | 11/1983 | Lang | 417/295 X |
| 4,470,427 | 9/1984 | Maillochaud | 417/295 X |
| 4,731,999 | 3/1988 | Niemiec | 60/468 |

FOREIGN PATENT DOCUMENTS

| | | | |
|---|---|---|---|
| 1231933 | 1/1967 | Fed. Rep. of Germany | 417/295 |
| 2546600 | 7/1976 | Fed. Rep. of Germany . | |
| 3306025 | 9/1983 | Fed. Rep. of Germany . | |
| 3734928 | 4/1988 | Fed. Rep. of Germany . | |
| 1308611 | 10/1962 | France | 60/459 |
| 86990 | 3/1990 | Japan | 417/295 |
| 1080001 | 8/1967 | United Kingdom . | |

OTHER PUBLICATIONS

Manuscript: "Grundlase der Ölhydraulik" Prof. Dr. -Ing. W. Backe—6. Auflage Aug. 1986 pp. 7–40, 7–41.

*Primary Examiner*—Edward K. Look
*Assistant Examiner*—John Ryznic
*Attorney, Agent, or Firm*—Evenson, Wands, Edwards, Lenahan & McKeown

[57] ABSTRACT

Device for controlling the pressure in a hydraulic pressure system in which the output of a constantly running pump which feeds pressure medium to a pressure system is controlled by means of a suction throttle valve which itself is actuated as a function of the pressure in the pressure system of the vacuum in the connection between pump and suction throttle valve.

An over pressure in the pump output acts to close the throttle valve, while under vacuum in the pump outlet acts to open the throttle valve, thus allowing for a two point control without additional control valves.

6 Claims, 3 Drawing Sheets

DEVICE FOR CONTROLLING THE PRESSURE IN A HYDRAULIC PRESSURE SYSTEM

BACKGROUND AND SUMMARY OF THE INVENTION

The invention relates to a device for controlling the pressure in a hydraulic pressure system, with a hydraulic pump connected to the pressure system on the delivery side and to a hydraulic reservoir on the suction side and with a suction throttle valve controlling the connection between hydraulic reservoir and hydraulic pump.

An arrangement of this generic type is disclosed in German Offenlegungsschrift 3,734,928, in which a suction throttle valve continuously varies the throttle resistance in the suction line, which can also be closed off completely, if appropriate. It is thus possible to control the delivery capacity of the pump, or to cut off the feed of pumping medium while the pump continues to run. A particular advantage of this arrangement is that, with the suction throttle valve closed, the pump works against only a very low resistance, and in all events when a return of the pumping medium from the pressure system is prevented by non-return valves in the delivery line of the pump.

According to German Offenlegungsschrift 3,734,928, an external control of the suction throttle valve is provided. No detailed particulars are given, however. Furthermore, German Offenlegungsschrift 2, 546,600 also shows a pump with suction-flow control. In this device the pressure of the pressure system connected to the pump is used to shift the suction-flow valve between its closed position and its open position. A control-slide arrangement transmits the pressure to a piston connected to the suction-flow valve, in such a way that the valve body of the suction-flow valve is pushed into the closed position. When the piston is relieved of pressure, an opening spring can then push the valve body together with the piston back into the open position again. To allow an especially reliable closing of the suction-flow valve, its valve body is so arranged that, during the closing stroke, it moves in the direction of flow of the suction flow. When the closed position is reached, a vacuum is generated on the outlet side of the suction-flow valve by the continued running of the pump, which loads the valve body of the suction-flow valve in the closed direction.

German Offenlegungsschrift 3,306,025 shows a rotary compressor with a suction throttle valve which is controlled as a function of the pressure o the delivery side of the rotary compressor. The pressure of the pressure system is conveyed via a control valve to a piston which, in addition to a closing spring, can load the valve body of the suction throttle valve in the closed direction counter to the direction of the suction flow. In order to prevent flutter vibrations in the valve body of the suction throttle valve, a two-point control must be guaranteed by the control valve; that is to say, after the piston additionally loading the valve body of the suction throttle valve in the closed direction has been subjected to pneumatic pressure via the control valve to increase the closing force, a relief of pressure should take place only when a certain pressure drop has occurred in the pressure system.

The publication "Grundlagen der Ölhydraulik" ["Fundamentals of Oil Hydraulics"] by W. Backé, Institut für hydraulische und pneumatische Antriebe und Steuerungen der RWTH Aachen, [Institute for Hydraulic and Pneumatic Drives and Controls of the RWTH Aachen], 1986, pages 7–40 and 7–41, shows a hydraulic pressure system with a pressure accumulator and with a reversing valve which is arranged on the delivery side of the pump feeding the pressure system and which, in its one switching state, connects it to the hydraulic reservoir. At the same time, between the pressure system and the reversing valve there is a non-return valve which, in the latter switching state of the reversing valve, prevents a pressure relief of the pressure system via the reversing valve. The reversing valve is controlled as a function of the pressure in the pressure system, a two-point control being guaranteed by separate pilot control valves. Accordingly, at a relatively high pressure in the pressure system, the reversing valve is switched into its circulation position connecting the delivery side of the pump to the reservoir; only after predetermined pressure drop in the pressure system does the reversing valve thereafter switch from the circulation position into the position connecting the pump to the pressure system. A fundamental disadvantage of an arrangement of this type is that, even during circulation, the pump works against a comparatively high resistance and therefore requires a relatively high power. In addition, the pumping medium can be heated substantially during circulation.

The object of the invention is, therefore, to provide a pressure control device which can be made with a low outlay in terms of construction, and which can be integrated with the pump in a simple way.

According to the invention, this object is achieved by providing the suction throttle valve with a slide-like closing member biased in an open position by a spring means A piston is loaded on one side by the pressure in the pressure system counter to the force of the spring means and on the other side by the pressure or vacuum prevailing between the hydraulic pump and the suction throttle valve. The suction throttle valve according to the invention can therefore be constructed in a simple way, similarly to conventional slide valves.

At the same time, an especially good switching behavior is guaranteed; that is, when the pressure in the hydraulic pressure system falls below a lower pressure threshold value the pump introduces pressure medium into this system until an upper pressure threshold value is reached. During the transmission of hydraulic medium into the hydraulic pressure system (with the suction throttle valve open), the vacuum occurring relative to the hydraulic reservoir between the suction throttle valve and the pump has a vanishing value. Accordingly, the instant at which the suction throttle valve closes is determined virtually solely by the pressure in the hydraulic pressure system. The suction throttle valve therefore closes as soon as this pressure, or the resulting force on the closing member in the closing direction, overcomes the force of the spring means acting in the opening direction of the closing member. Because the pump continues to run after closing of the suction throttle valve, a higher vacuum is established between the suction throttle valve and the pump, which acts in the closing direction of the closing member. As a result, the suction throttle valve can open again only when the pressure loading the closing member with a closing effect has fallen in the hydraulic pressure system so far that the force of the spring loading the closing member in the opening direction is sufficient to overcome the sum of the forces which act in the closing direction of the closing member, and which are generated by the pressure in the hydraulic pressure system on the one hand and by the vacuum on the other hand.

Utilizing the vacuum thus provides a reproducible limited hysteresis in the switching behavior of the throttle valve, that is to say a two-point control is guaranteed automatically, without additional control valves.

Other objects, advantages and novel features of the present invention will become apparent from the following detailed description of the invention when considered in conjunction with the accompanying drawings

DETAILED DESCRIPTION OF THE DRAWING

Figure 1:
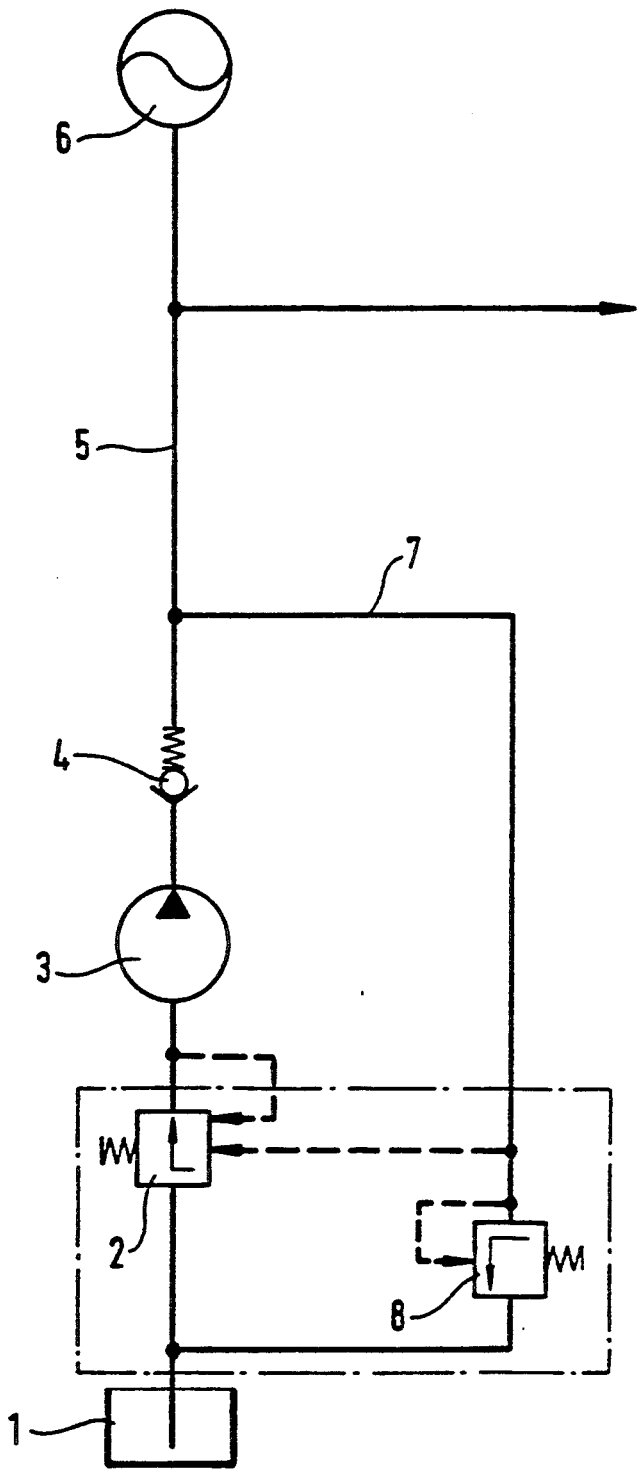
FIG. 1 shows a representation of the entire system in the form of a circuit diagram.

Referring the FIG. 1, a hydraulic reservoir 1 is connected via a suction throttle valve 2 to the suction side of a pump 3 which is connected on the delivery side, via a non-return valve 4 preventing a return flow towards the pump 3, to a hydraulic pressure system, of which FIG. 1 shows only a delivery line 5 leading to consumers (not shown) and a pressure accumulator 6 connected hereto.

A line 7 branches off from the delivery line 5 and leads to a pressure-limiting valve 8 which is integrated with the suction throttle valve 2 in a manner discussed in greater detail below. When a permissible maximum pressure is exceeded, pressure limiting valve 8 connects the line 7 to the reservoir 1 and thus prevents a further pressure rise in the delivery line 5. Pressure-limiting valve 8 thus performs merely a safety function, and is inactive when the suction throttle valve 2 is working correctly, because the pressure in the delivery line 5 remains below the permissible maximum value.

As a function of the pressure in the line 7 or in the delivery line 5 and the pressure in the connection between suction throttle valve 2 and pump 3, the suction throttle valve 2 controls the flow of hydraulic medium to the suction side of the pump 3 in such a way that the suction throttle valve 2 closes as soon as the delivery line 5 or the line 7 carries a pressure above an upper pressure threshold value, and opens as soon as this pressure falls below a lower pressure threshold value.

Figure 2:
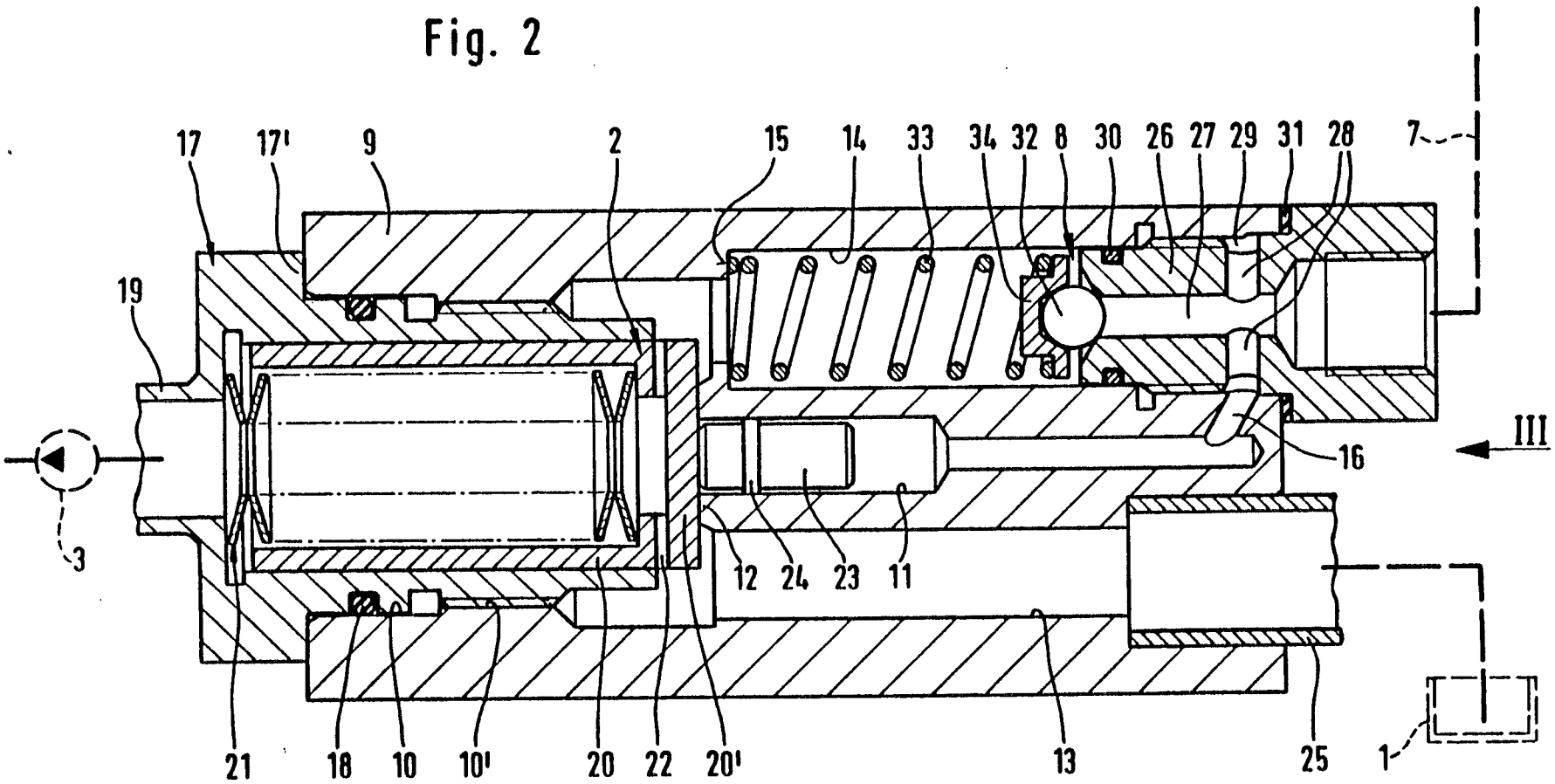
FIG. 2 shows an axial section through the suction throttle valve.
Figure 3:
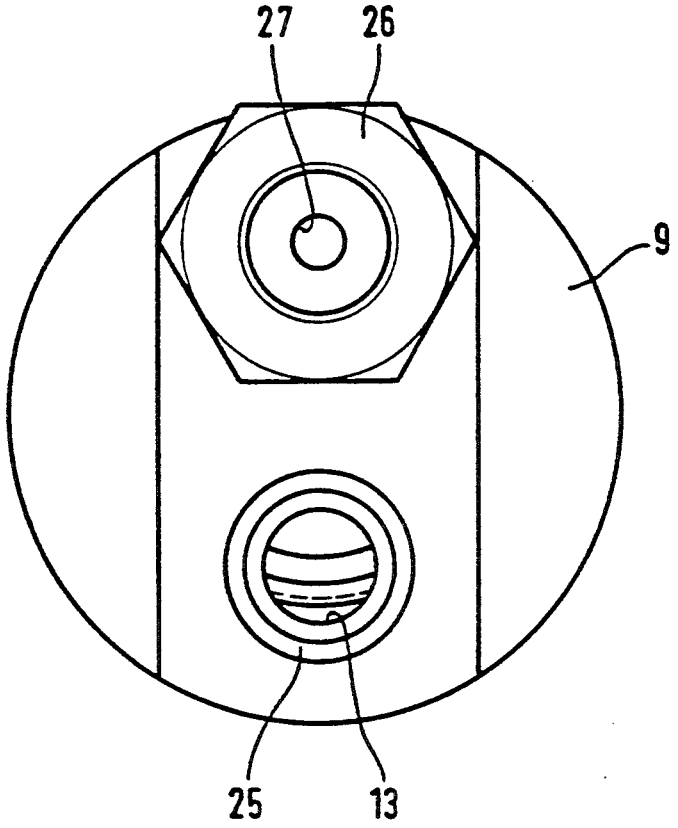
FIG. 3 shows an end view of the suction throttle valve according to the arrow III in FIG. 2.

Referring now to FIGS. 2 and 3, the suction throttle valve 2 and the pressure-limiting valve 8 are accommodated in a common housing 9 which has, for example, a circular cross-section, and possesses a central bore 10 of relatively large diameter on its side of the left FIG. 2. This bore 10, which is equipped with an internally threaded portion 10', is continued in a stepped, centrally arranged blind bore 11, of which the end of the larger diameter adjoins the bore 10. At the mouth of the blind bore 1 opening into the bore 10, an annular web 12 surrounding the said mouth is arranged in the bottom of the bore 10.

From the end of the housing 9 on the right in FIG. 2, two eccentric axial bores 13 and 14 open radially into the bore 10 outside the annular web 12. The bore 14 narrows just in front of its mouth opening into the bore 10, to form a step 15. In addition, an oblique bore 16 near the end of the axial bore 14 on the right in FIG. 2 connects the end of the blind bore 11 to the above mentioned axial bore 14.

The bore 10 of the housing 9 receives a sleeve-shaped insert part 17 which is screwed by means of an external thread into the threaded portion 10' of the bore 10 and which is clamped by means of a flange-like collar 17' against the end face of the housing 9 on the left in FIG. 2. A sealing ring 18 is arranged in a circumferential groove of the insert part 17, in order to seal off the gap between the wall of the bore 10 and the insert part 17.

The insert part 17 has connection piece 19 leading to the suction connection of the pump 3 and, within the insert part 17, leading into a cylinder space which receives displaceably a piston 20 forming the closing member of the suction throttle valve 2. Arranged within the piston 20 is a cup-spring assembly 21 which is supported at one end on the annular step formed within the insert part 17 at the mouth of the connection piece 19 and on the other end by an annular step near the piston bottom 20' and which biases the piston 20 in the open position, as shown in FIG. 2, in which the piston bottom 20' bears against the annular web 12. The cup springs of the spring assembly 21 are annular, in such a way that a channel leading from the connection piece 19 as far as the inside of the piston bottom 20' is formed within the cup-spring assembly 21. Arranged near the piston bottom 20', in the piston 20, are slots 22 which pass radially through the circumferential wall of the latter and which, in the illustrated opening position of the piston 20, connect the said channel within the cup-spring assembly 21 to the annular space formed between the end of the piston 20 projecting from the insert part 17 to the right in FIG. 2 and the circumferential wall of the housing bore 10. When the piston 20 is displaced to the left in FIG. 2, counter to the force of the cup-spring assembly 21, the slots 22 are covered by the tubular end of the insert part 17 on the right in FIG. 2, and are consequently closed off.

A control piston 23 is disposed displaceably within the portion of larger diameter of the blind bore 11, the annular gap between the circumferential face of the control piston 23 and the wall of the blind bore 11 being sealed off by means of sealing ring arrangement 24.

The hydraulic reservoir 1 (See FIG. 1) is connected to the axial bore 13 of the housing 9 by means of a line 25. A junction piece 26 for the line 7 (see FIG. 1) is screwed into the other axial bore 14. This junction piece 26 possesses an axial channel 27 communicating via radial bores 28 with an annular space 29 which is itself formed by a circumferential groove arranged in the circumferential wall of the junction piece 26. This annular space 29 is connected to the blind bore 11 via the oblique bore 16 arranged in the housing 9, so that the hydraulic pressure within the axial channel 27 also acts, via the radial bores 28, the annular space 29, the oblique bore 16 and the part of the blind bore 11 communicating with this, on the end face of the control piston 23 on the right in FIG. 2.

On both sides of the annular space 29, the gap between the outer circumference of the junction piece 26 and the axial bore 14 of the housing 9 is closed off in a pressure-tight manner by means of gaskets 30 and 31.

The mouth of the axial channel 27 is designed, at the end of the junction piece 26 of the left in FIG. 2, as the seat of a valve ball 32 which constitutes the closing member of the pressure-limiting valve 8. The valve ball 32 is tensioned into the illustrated closing position by means of a strong valve spring 33. The valve spring 33 is clamped between the annular step 15 of the axial bore 14 and a plate-like moveable abutment part 34, which, on its side facing the valve ball 32, has a depression for mounting the valve ball 32. The abutment part 34 has a somewhat smaller diameter than the axial bore 14, so that hydraulic medium can flow between the outer circumference of the abutment part 34 and the wall of the axial bore 14. If appropriate, axial slots can also be arranged on the outer circumference of the abutment part 34 to allow the passage of hydraulic medium. In this case, the outside diameter of the abutment part 34 can correspond approximately to the inside diameter of the axial bore.

Thus, when the valve ball 32 is displaced to the left in FIG. 2 counter to the force of the valve spring 33, hydraulic medium can flow out of the axial channel 27 of the junction piece 26 past the abutment part 34, through the axial bore 14 of the cross-section left free within the axial bore 14 by the valve spring 33 and into the bore 10 of the housing 9 and from there, irrespective of the position of the piston 20, into the axial bore 13 and consequently into the hydraulic reservoir 1 connected hereto.

The arrangement in FIGS. 2 and 3 functions as follows:

When the suction throttle valve 2 is workingly correctly, the pressure-limiting valve 8 remains closed. Should it open as a result of an undesirable pressure rise in the delivery line 5 and the line 7 (see also FIG. 1), hydraulic medium then flows from the delivery line 5 via the line 7 into the hydraulic reservoir 1 in the above-described way, until the pressure has fallen so far that then valve spring 33 can once more urge the valve ball 32 into the closed position shown in FIG. 2.

With the pressure-limiting valve 8 closed, the pressure in the delivery line 5 and in the line 7 (see also FIG. 1) is transmitted to the end face of the control piston 23 on the right in FIG. 2, since the line 7 is connected to the portion of the blind bore 11 on the right in FIG. 2 via the axial channel 27, the radial bores 28 of the junction piece 26 and the oblique bore 16 in the housing 9.

So long as the pressure acting on the right end face of the control piston is insufficient to displace the piston 20 to the left out of the position shown in FIG. 2 into its closed position, the axial bore 13 remains connected, via the slots 22 located on the piston, to the interior of the piston 20 and therefore to the interior of the insert part 17; that is to say, the suction side of the pump 3 (see also FIG. 1) is connected to the hydraulic reservoir 1. The constantly running pump 3 therefore conveys hydraulic medium to the delivery line 5, so that the pressure in this line 5 and in the pressure accumulator 6 (see also FIG. 1) rises correspondingly.

As soon as an upper pressure threshold value is reached, the pressure forces acting on the right end face of the control piston 23 are sufficient to displace the control piston 23 and consequently also the piston 20 to the left in FIG. 2, so that the slots 22 located on the piston are pushed into the insert part 17 and thereby shut off. The connection between the suction side of the pumps 3 and the hydraulic reservoir 1 is thus broken. Since the pump 3 continues to run constantly, a vacuum is generated within the interior of the piston 20 displaced to the left in FIG. 2 and within the insert part 16 and is maintained as long as the piston 20 remains in the closed position, that is to say as long as the slots 22 are closed off. This vacuum in relation to the low pressure in the axial bore 13 connected to the hydraulic reservoir 1 combines with the force exerted on the piston 20 by the control piston 23, to urge the piston 20 into the closed position in which the pump 3 is separated from the hydraulic reservoir 1.

Accordingly, the cup-spring assembly 21 can displace the piston 20 once again into the opening position, as shown in FIG. 2, only when the pressure forces acting on the right end face of the control piston 23 decrease by an amount which corresponds to the force exerted by the above mentioned vacuum on the piston 20 counter to the force of the cup-spring assembly 21.

Thus, the vacuum which can be generated on the suction side of the pump 3 with the suction throttle valve 2 closed (that is with the piston 20 displaced to the left as shown in FIG. 2) determines the hysteresis with which the suction throttle valve 2 operates. This is equivalent to saying that the vacuum determines the difference between an upper threshold value of the hydraulic pressure acting on the right end face of the control piston 23, at which the suction throttle valve 2 is closed, and a lower threshold value of the above mentioned pressure, at which the suction throttle valve 2 opens.

Depending on whether the piston 20 has a larger or smaller cross-section, the vacuum can generate a higher or lower hysteresis or difference between the above mentioned pressure threshold values.

The valve design illustrated is characterized by a simple construction. The bores 10, 11, 13 and 14 arranged in the housing 9 can be made from the housing end faces. The oblique bore 16 can be made in the housing 9 from the end of the axial bore 14 on the right in FIG. 2.

The piston 20 can be introduced together with the cup-spring assembly 21 into the insert part 17 which, after the control piston 23 has been pushed into the end of the blind bore 11 opening into the bore 10, is then screwed into the bore 10. The suction throttle valve 2 is thus assembled virtually completely.

To assemble the pressure-limiting valve 8, first the valve spring 33 and the abutment part 34, together with the valve ball 32, are introduced into the axial bore 14. The pressure-limiting valve 8 is thus assembled and ready for use.

Another advantage of the valve arrangement illustrated is its especially compact construction. The housing 9, together with the suction throttle valve 2 and the pressure-limiting valve 8, can therefore be arranged directly on the pump 3 or on the pump casing. For use in motor vehicles, the pump 3 can thus be mounted, for example, jointly with the housing 9 on the engine block.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. Device for controlling the pressure in a hydraulic pressure system comprising:

a hydraulic reservoir;

a hydraulic pump having a delivery side and a suction side, said delivery side being connected to said pressure system, and said suction side being connected to said hydraulic reservoir;

a suction throttle valve controlling the connection between said hydraulic reservoir and said hydraulic pump;

said suction throttle valve having slide like closing member in the form of a piston;

spring means for biasing said piston towards an open position thereof;

means for transmitting pressure from said pressure system to a first side of said piston, counter to force of said spring means; and means for applying a vacuum prevailing between said hydraulic pump and said suction throttle valve, to a second side of said piston opposite said first side, whereby said vacuum and said pressure from said pressure system urge said piston toward a closed position thereof;

wherein said piston has an interior longitudinal bore therein and radial slots which pass through a piston wall surrounding said interior bore, which slots, in said open position of said piston, connect inlet and outlet sides of said suction throttle valve through said interior longitudinal bore.

2. Device according to claim 1, wherein a control piston loaded on its one end face by the pressure in the pressure system urges the piston into its closed position counter to the force of the spring means.

3. Device according to claim 1, wherein a control piston loaded on its one end face by the pressure in the pressure system urges the piston into its closed position counter to the force of the spring means.

4. Device according to claim 3, wherein a working space of the control piston assigned to one end face of the control is connected to the pressure system via an inlet side of pressure-limiting valve.

5. Device according to claim 4, wherein the pressure-limiting valve and the suction throttle valve are accommodated in a common housing.

6. Device according to claim 5, wherein the outlet of the pressure-limiting valve communicates with the inlet side of the suction throttle valve.

* * * * *